US006639501B2

(12) United States Patent
Wang et al.

(10) Patent No.: US 6,639,501 B2
(45) Date of Patent: Oct. 28, 2003

(54) LOW VOLTAGE BOBBIN OF A FLYBACK TRANSFORMER

(75) Inventors: Ching Hsiang Wang, Tao Yuan Hsien (TW); Reiy Long Wang, Tao Yuan Hsien (TW)

(73) Assignee: Sampo Corporation, Tao Yuan Hsien (TW)

( * ) Notice: Subject to any disclaimer, the term of this patent is extended or adjusted under 35 U.S.C. 154(b) by 23 days.

(21) Appl. No.: 10/100,016

(22) Filed: Mar. 19, 2002

(65) Prior Publication Data

US 2003/0179065 A1 Sep. 25, 2003

(51) Int. Cl.[7] ..... H01F 27/30
(52) U.S. Cl. ..... 336/208; 336/192; 336/198
(58) Field of Search ..... 336/192, 96, 178, 336/200, 198, 208; 29/602.1

(56) References Cited

U.S. PATENT DOCUMENTS

| | | | | | |
|---|---|---|---|---|---|
| 4,414,578 | A | * | 11/1983 | Takeichi | 348/378 |
| 5,745,020 | A | * | 4/1998 | Shen-Long et al. | 336/92 |
| 5,898,354 | A | * | 4/1999 | Lee | 336/96 |
| 6,010,362 | A | * | 1/2000 | Caviness et al. | 439/567 |
| 6,329,896 | B1 | * | 12/2001 | Lu et al. | 336/90 |
| 6,346,001 | B1 | * | 2/2002 | Lu et al. | 439/357 |
| 6,433,663 | B1 | * | 8/2002 | Fitzgerald, Jr. et al. | 336/178 |

* cited by examiner

*Primary Examiner*—Anh Mai
(74) *Attorney, Agent, or Firm*—Rosenberg, Klein & Lee

(57) ABSTRACT

A low voltage bobbin includes a core portion, a base portion, a plurality of insertion pins formed on an outer wall of the base portion, and a wire winding rod axially extending from each of the insertion pin. The thickness of portion of the outer wall of the base portion that is corresponding to each of the plurality of insertion pins is thinned down, each of the wire winding rod has a descending diameter from a root end to a free distal end of the wire winding rod.

7 Claims, 6 Drawing Sheets

LOW VOLTAGE BOBBIN OF A FLYBACK TRANSFORMER

BACKGROUND OF THE INVENTION

1. Field of the Invention

The present invention relates to the field of flyback transformers, and more particularly, to a flyback transformer having an improved low voltage bobbin that is capable of installing at least two different sizes of iron shafts. The improved low voltage bobbin according to this invention can prevent short-circuiting while installing different sizes of iron shafts.

2. Description of the Prior Art

A flyback transformer is generally implemented within the circuits of a display device for providing distinctive voltages required by the circuit operation of the display device. Due to the trend toward smaller or thinner customer electrical apparatuses, the dimension of the flyback transformer is limited.

Please refer to FIG. 1. FIG. 1 is a perspective diagram of a conventional low voltage bobbin of a flyback transformer (FBT). The low voltage bobbin generally comprises a base portion 1 and a core portion 2 that is pivotally connected to a front side of the base portion 1. Multiple insertion pins 13 extend upwardly from the outer wall 11 of the half-moon-like base portion 1. Wire winding rods 14, which extend axially from back side of each of the insertion pins, are provided.

Please refer to FIG. 2 and FIG. 3 with respect to FIG. 1. FIG. 2 is a cross sectional view of a prior art low voltage bobbin with an iron shaft installed therein. FIG. 3 is a plane view of the low voltage bobbin of FIG. 2. As shown in FIG. 2 and FIG. 3, an iron shaft 3 is inserted into the space defined by the core portion 2 and the base portion 1. The surface of the iron shaft 3 is in contact with the inner wall 12 of the base portion 1.

However, the prior art low voltage bobbin is only suitable for a specific size of iron shaft, for example, 10 mm iron shaft. When one wants to install a bigger iron shaft into the low voltage bobbin, for example, 11 mm iron shaft, he or she must order a bigger low voltage bobbin in order to fit the bigger iron shaft, and also a bigger casing that covers the low/high voltage bobbins. This will largely increase the overall production cost. Moreover, the bigger low voltage bobbin obeys the current trend of size shrinking.

FIG. 2 and FIG. 3 also imply the difficulties and problems that might be encountered when installing a 11 mm iron shaft into a 10 mm low voltage bobbin. As shown, the gap between the wire winding rods 14 and the outer wall 11 of the base portion 1 is narrow. Without changing the size of the low voltage bobbin, the installation of a 11 mm iron shaft into the 10 mm low voltage bobbin will cause short-circuiting problems resulting from undesirable contact between the wire winding rods 14 and the outer wall 11.

Consequently, there is a need to provide an improved low voltage bobbin of a flyback transformer to solve the above-mentioned problems.

SUMMARY OF THE INVENTION

It is therefore a primary object of the present invention to provide an improved low voltage bobbin of a flyback transformer that is capable of installing at least two different sizes (ex. 10 mm and 11 mm) of iron shafts and also maintaining the insulation property and original size of the low voltage bobbin.

It is another objective of this invention to provide an improved low voltage bobbin for flyback transformers having mechanically strengthened slender wire winding rods.

According to the claimed invention, the low voltage bobbin comprises a core portion, a base portion, a plurality of insertion pins formed on an outer wall of the base portion, and a wire winding rod axially extending from each of the insertion pin. The thickness of portion of the outer wall of the base portion that is corresponding to each of the plurality of insertion pins is thinned down. Each of the wire winding rod has a descending diameter from a root end to a free distal end of the wire winding rod.

Moreover, symmetric cutting sides may be formed on each of the elliptic rods on opposite ends of the long radius.

Further, symmetric cutting sides may be formed on two sides of each of the elliptic rods.

It is to be understood that both the forgoing general description and the following detailed description are exemplary, and are intended to provide further explanation of the invention as claimed. Other advantages and features of the invention will be apparent from the following description, drawings and claims.

DETAILED DESCRIPTION OF THE PREFERRED EMBODIMENT

Figure 1:
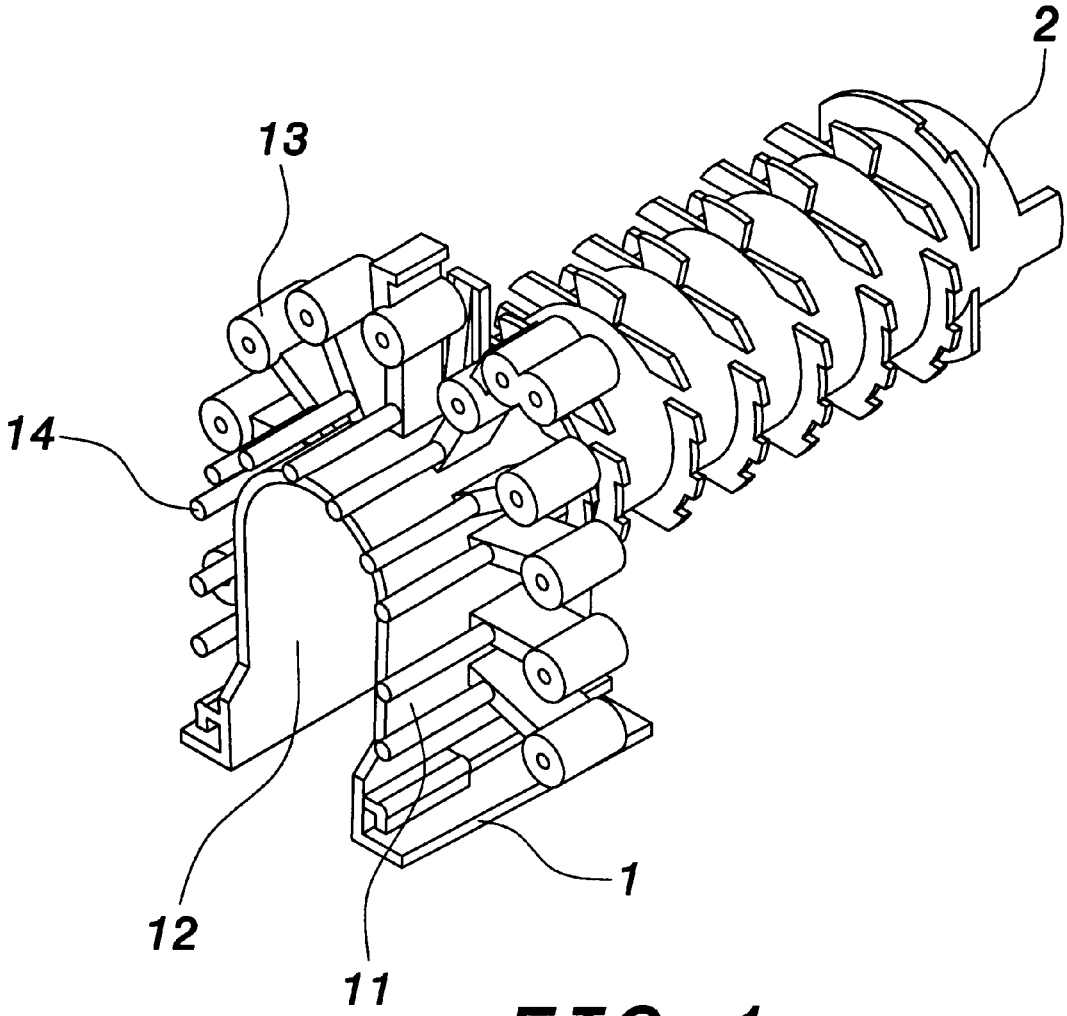
FIG. 1 PRIOR ART
FIG. 1 is a perspective diagram of a conventional low voltage bobbin of a flyback transformer.
Figure 2:
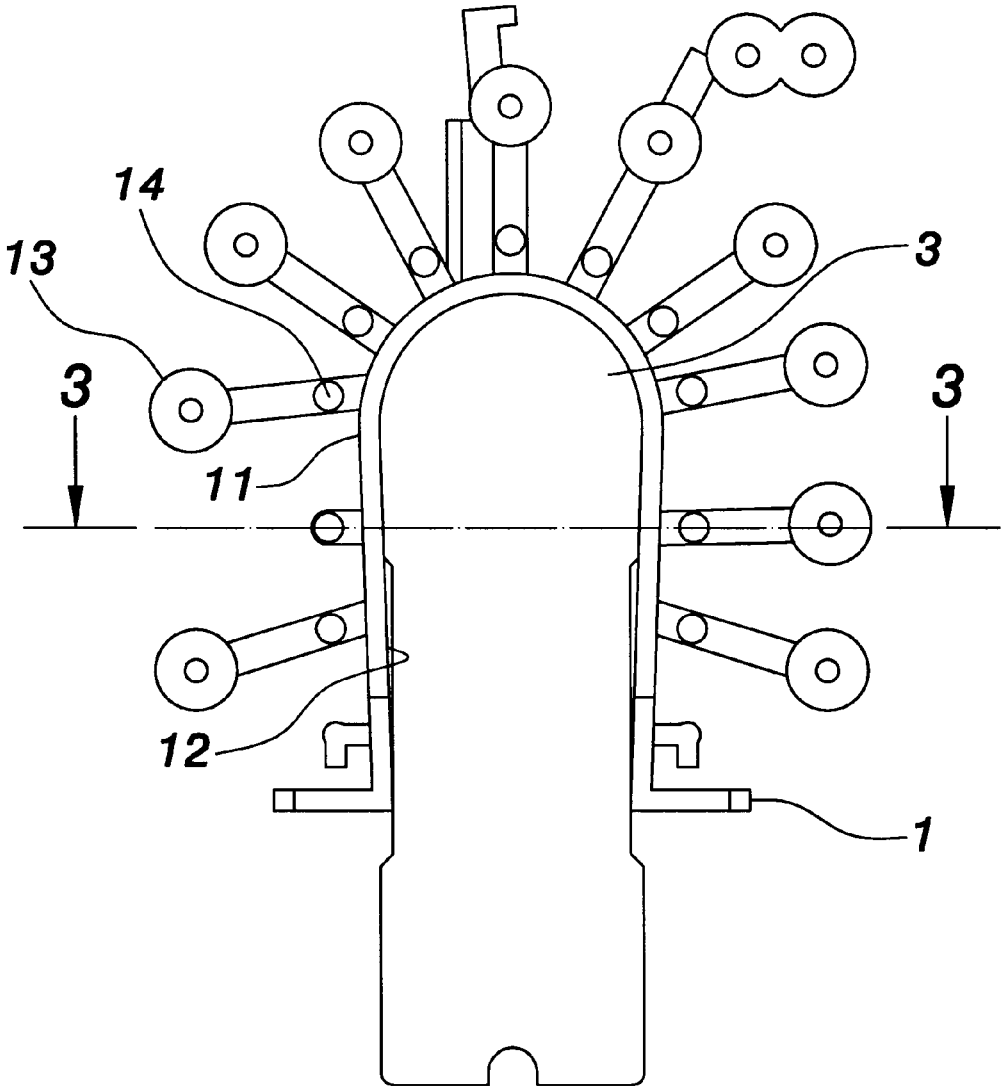
FIG. 2 PRIOR ART
FIG. 2 is a cross sectional view of a prior art low voltage bobbin with an iron shaft installed therein.
Figure 3:
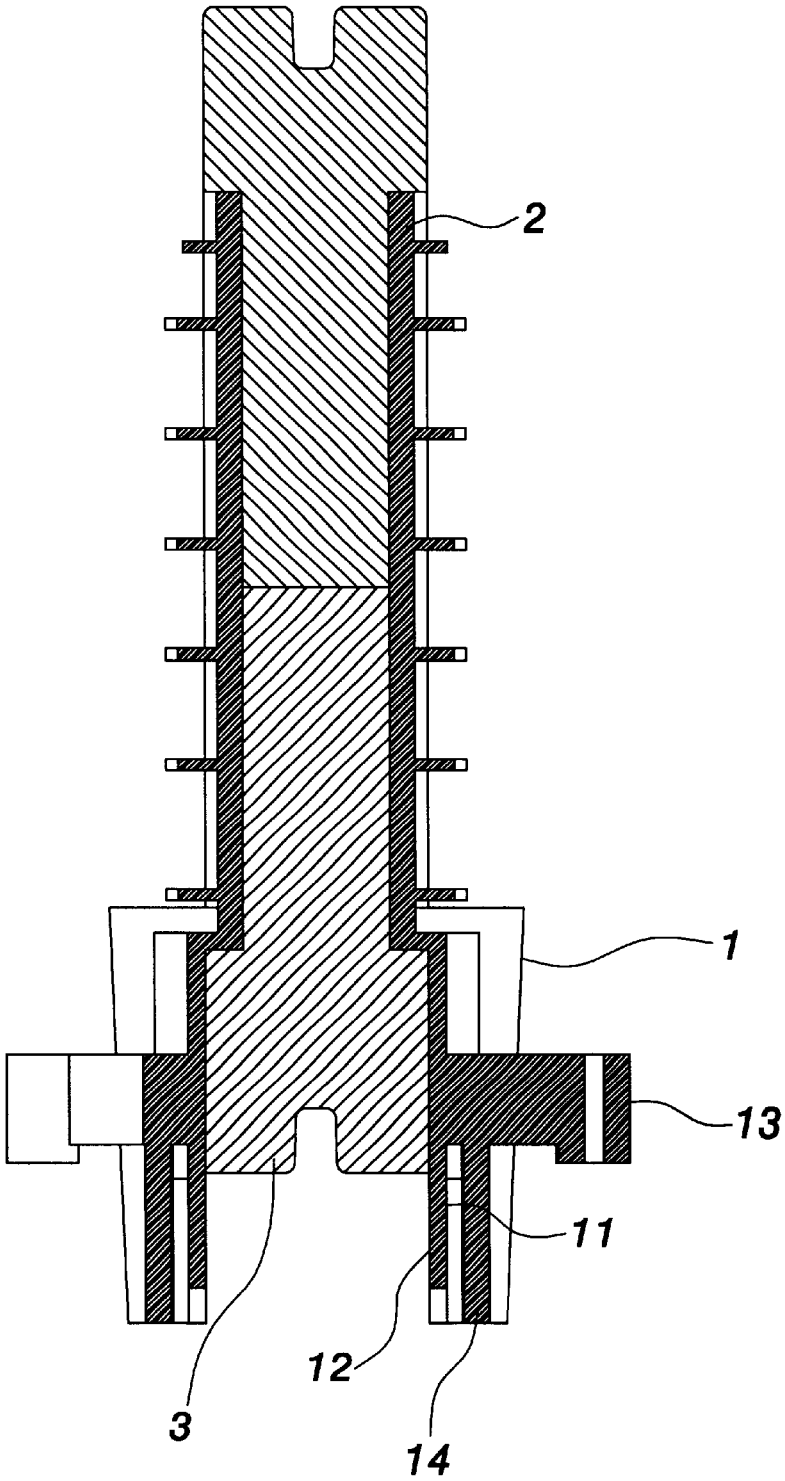
FIG. 3 PRIOR ART
FIG. 3 is plane view of the low voltage bobbin of FIG. 2 along line 3—3.
Figure 4:
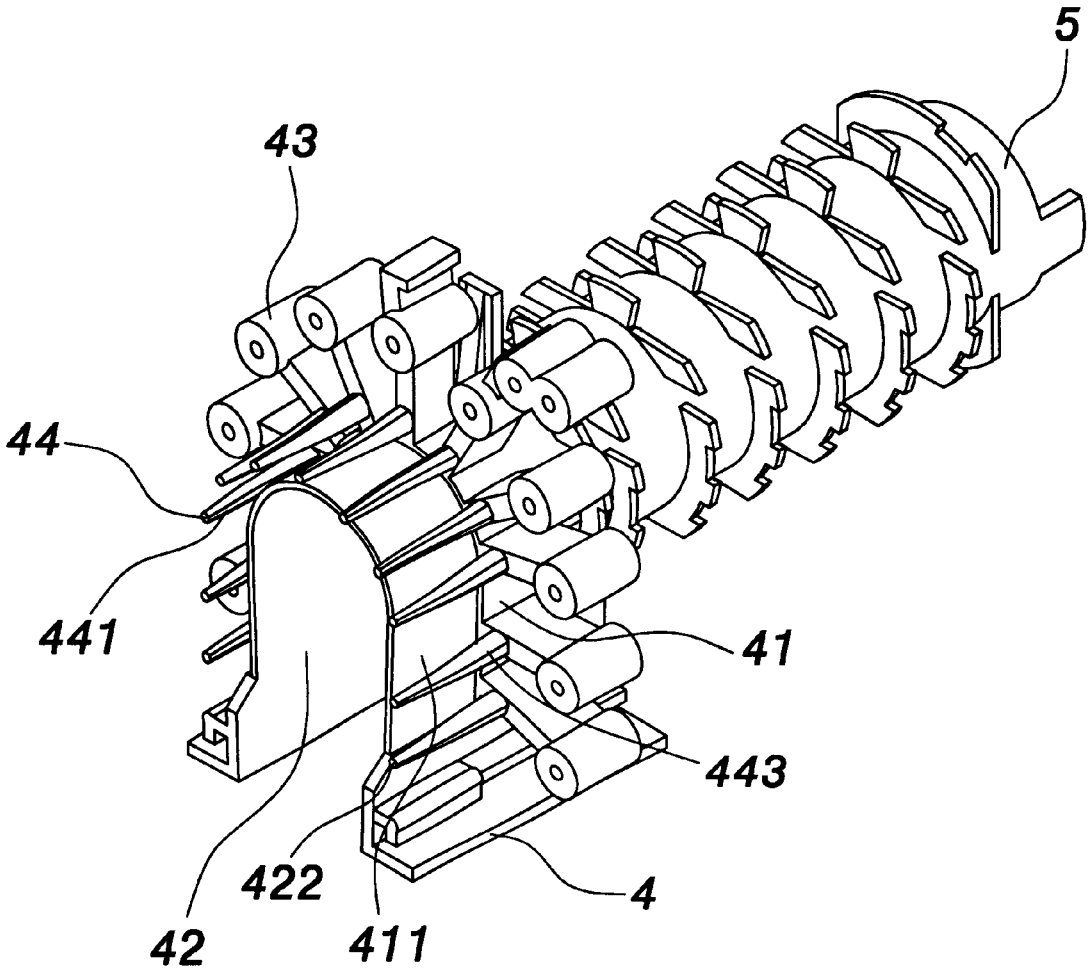
FIG. 4 is a perspective diagram of a low voltage bobbin of a flyback transformer according to this invention.

Please refer to FIG. 4. FIG. 4 is a schematic diagram depicting a low voltage bobbin according to one preferred embodiment of this invention. A flyback transformer generally includes a low voltage bobbin, an iron shaft, a high voltage bobbin, and a casing. As shown in FIG. 4, the low voltage bobbin of this present invention includes a core portion 5, a base portion 4, and multiple insertion pins 43 formed on the outer wall 41 of the base portion 4. Likewise, there is provided a wire winding rod 44 on each of the insertion pins 43.

As mentioned, one of the purposes of this invention is to provide a low voltage bobbin that is capable of installing at least two different sizes of iron shafts without changing the original size of the low voltage bobbin. The details of how to achieve this goal will be discussed hereinafter.

Since an iron shaft having a larger diameter, for example, 11 mm, will be pushed the inner wall 42 of the base portion 4. This leads to a decreased distance between the outer wall 41 of the base portion 4 and the wire winding rods 44. In other words, a low voltage bobbin installed with an iron shaft having a larger diameter is subject to short-circuiting problems. Accordingly, the diameter of the wire winding rods 44 descended from the root end 443 to the free distal end 442 and each of the wire winding rods 44 has conoid-shaped. By this way, the distance between the outer wall 41 of the base portion 4 and the wire winding rods 44 is increased.

Figure 5:
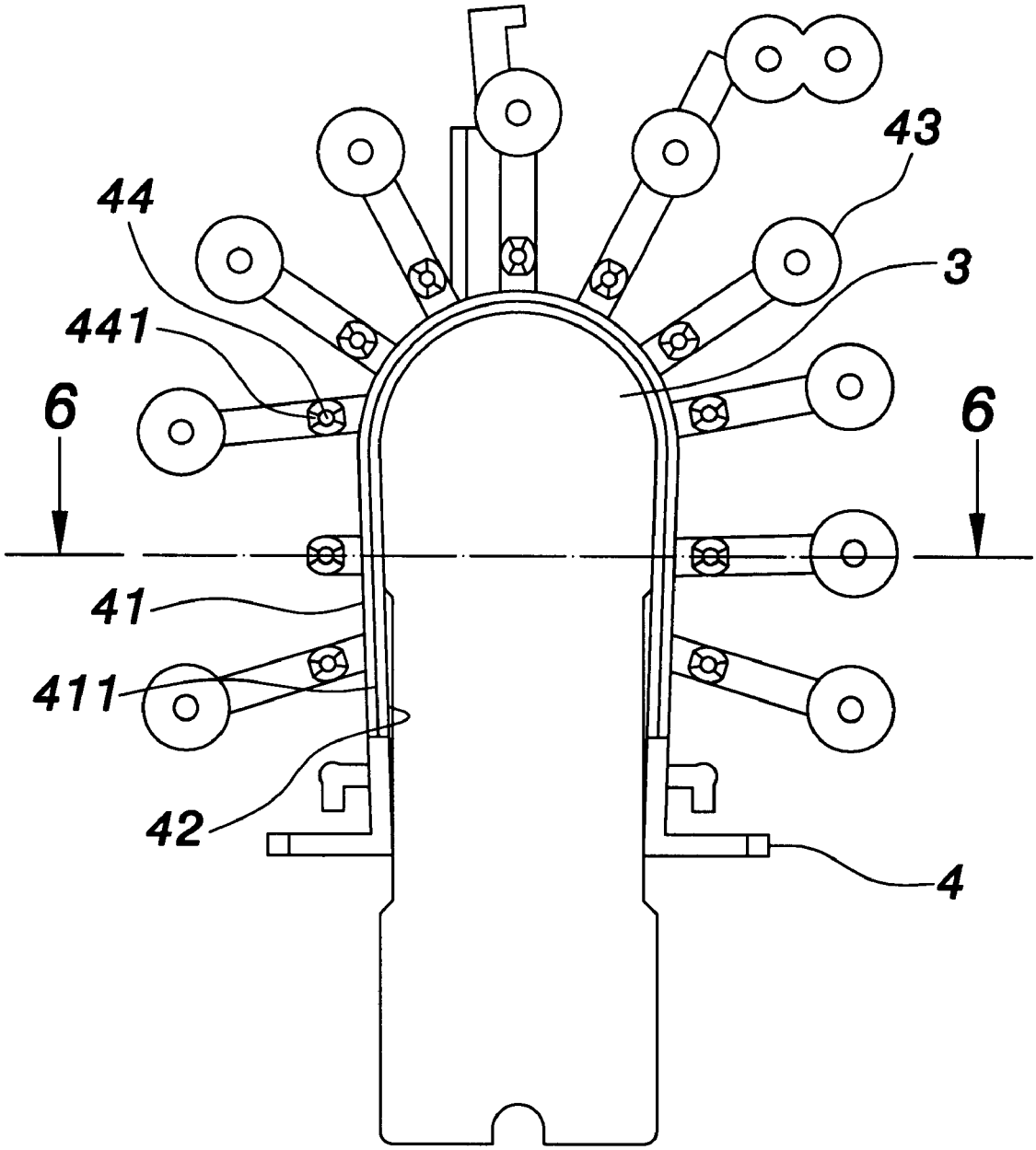
FIG. 5 is a cross sectional view of a low voltage bobbin with an iron shaft installed therein according to this invention.

However, these slender wire winding rods 44 will also cause insufficient mechanical strength when in use. Hence, a wire winding rods 44 having an elliptic cross section is suggested. Also, as shown in FIG. 5, the long radius of the wire winding rods 44 is in parallel with the extension direction of corresponding insertion pin 43. By doing so, the mechanical strength of the wire winding rods 44 may be further enhanced.

Figure 6:
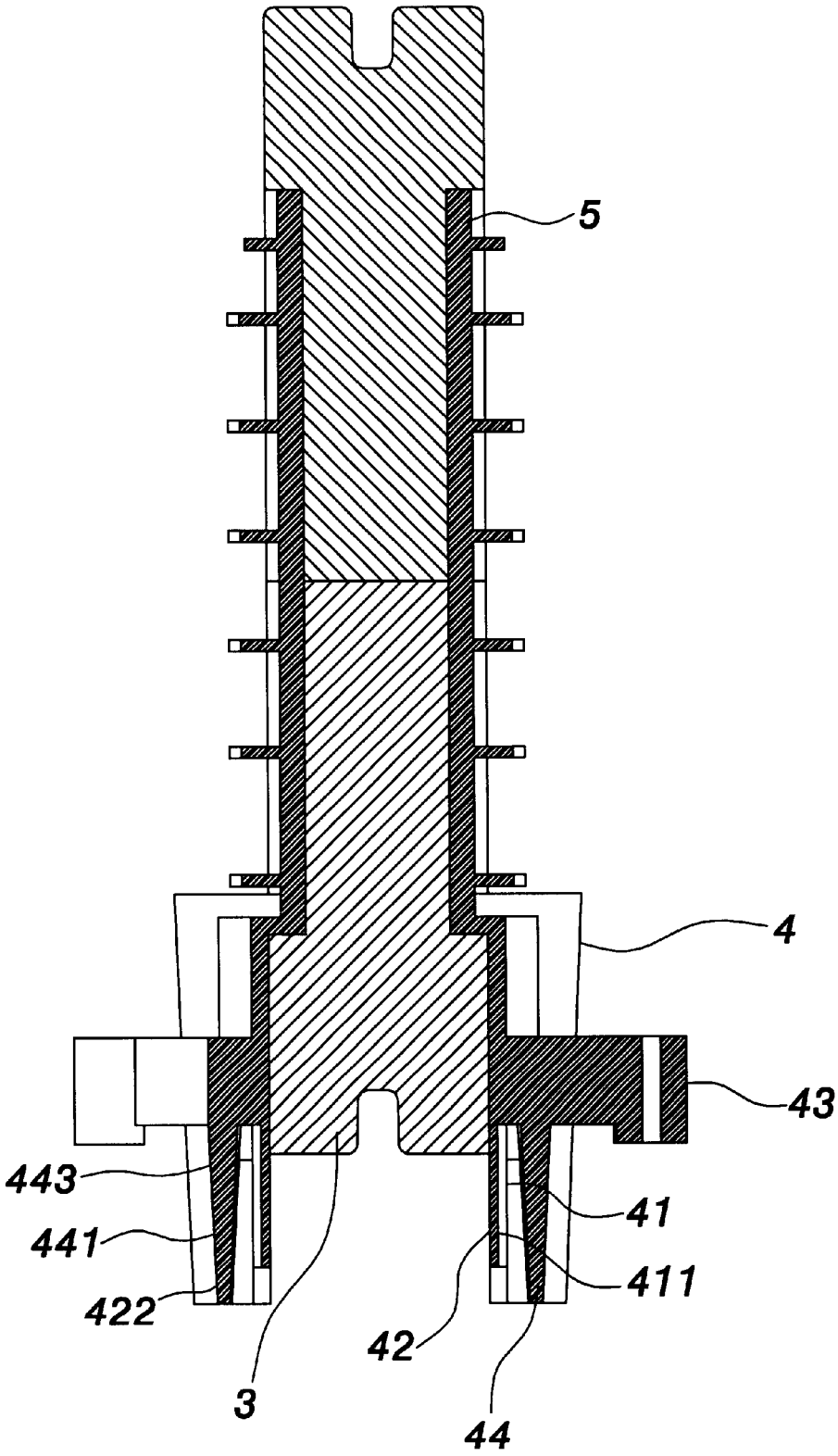
FIG. 6 is plane view of the low voltage bobbin of FIG. 5 along line 6—6.

Still referring to FIG. 4 to FIG. 6. An approach to decrease the above-mentioned distance is also illustrated in FIG. 4 to FIG. 6. As shown in FIG. 4 to FIG. 6, the thickness of the base portion 4 between the outer wall 41 and the inner wall 42 is thinned down within the area corresponding to each of the wire winding rods 44. In the preferred embodiment of this invention, a portion of the base portion within the area corresponding to each of the wire winding rods 44 is chipped off to form a smooth surface of second outer wall 411. The second outer wall 411 and the outer wall 41 form a step-drop geography.

Furthermore, as shown in FIG. 4 and FIG. 5, symmetric cutting sides 441 are formed on each of the wire winding rods 44. Preferably, the symmetric cutting sides 441 are formed on opposite ends of the long radius of the wire winding rods 44. These cutting sides 441 is able to further increase the distance as mentioned.

In short, the structure of the low voltage bobbin according to this invention features its increased gap between the wire winding rods 44 and the outer wall 41 of the base portion 4. This can be done by utilizing the approaches as discussed above, i.e. shrinking the diameter of the wire winding rods 44, thinning the outer wall 41 (to form the second outer wall 411), and forming the symmetric cutting sides 441.

In contrast to the prior art, this invention overcomes the drawbacks of the conventional approach. Short-circuiting problems due to the use of a larger iron shaft are eliminated. Further, the present invention provides a flyback transformer more reliable than the prior art approach.

Those skilled in the art will readily observe that numerous modification and alterations of the device may be made while retaining the teachings of the invention. Accordingly, the above disclosure should be construed as limited only by the metes and bounds of the appended claims.

What is claimed is:

1. A low voltage bobbin of a flyback transformer comprising:

a base portion having a plurality of insertion pins projected on outer face thereof, a wire winding rod axially extending from each of the insertion pin, the thickness of portion of the outer wall of the base portion that is corresponding to each of the plurality of insertion pins is thinned down, each of the wire winding rod has a root end and a free distal end, a diameter of the wire winding rods descended from the root end to the free distal end; and a core portion connected to front side of the base portion.

2. The low voltage bobbin of claim 1 wherein the thinned outer wall of the base portion formed a step-drop second outer wall.

3. The low voltage bobbin of claim 2 wherein the second outer wall is formed by cutting the base portion.

4. The low voltage bobbin of claim 1 wherein each of the wire winding rods has conoid-shaped with an elliptic cross section.

5. The low voltage bobbin of claim 4 wherein each of the wire winding rods has a long radius that is in parallel with the extending direction of the insertion pin.

6. The low voltage bobbin of claim 5 wherein symmetric cutting sides are formed on each of the elliptic rods on opposite ends of the long radius.

7. The low voltage bobbin of claim 1 wherein symmetric cutting sides are formed on two sides of each of the elliptic rods.

* * * * *